US012325573B1

(12) United States Patent
Yuan

(10) Patent No.: US 12,325,573 B1
(45) Date of Patent: Jun. 10, 2025

(54) DOUBLE-LAYER STRUCTURED CUSHIONING CORNER PROTECTOR

(71) Applicant: NINGBO ANSOL CABINET CO., LTD., Zhejiang (CN)

(72) Inventor: Limin Yuan, Zhejiang (CN)

( * ) Notice: Subject to any disclaimer, the term of this patent is extended or adjusted under 35 U.S.C. 154(b) by 0 days.

(21) Appl. No.: 18/883,200

(22) Filed: Sep. 12, 2024

(30) Foreign Application Priority Data

Jun. 24, 2024 (CN) ..... 202410821118.4

(51) Int. Cl.
*B65D 81/05* (2006.01)

(52) U.S. Cl.
CPC ..... *B65D 81/056* (2013.01); *B65D 2581/055* (2013.01)

(58) Field of Classification Search
CPC . B65D 81/05; B65D 81/056; B65D 2581/055
USPC ..... 206/453, 586; 248/345.1
See application file for complete search history.

(56) References Cited

U.S. PATENT DOCUMENTS 4,483,444 A * 11/1984 Gardner ..... B65D 81/054 206/453
5,267,651 A * 12/1993 Hughes ..... B65D 5/5033 206/453
5,789,049 A * 8/1998 Randles ..... B65D 81/056 229/199
6,286,683 B1 * 9/2001 Hunt ..... B65D 81/054 206/586
6,629,608 B2 * 10/2003 Hurley ..... B65D 81/056 206/453
8,201,796 B2 * 6/2012 Belyea ..... A47B 95/043 206/453
9,016,652 B2 * 4/2015 Belyea ..... A47B 95/043 248/345.1

* cited by examiner

*Primary Examiner* — Bryon P Gehman

(57) ABSTRACT

A double-layer structured cushioning corner protector, comprises a corner protector body, the corner protector body has a double-layer wall structure, a cavity is arranged between the double-layer walls. Furthermore, to increase strength, concave platforms or holes can be set up on inner and outer walls to provide support and reinforcement between them, using environmentally friendly flame-retardant and tough materials to manufacture the protective corner body with a double-wall cushioning structure can achieve the cushioning performance required for packaging while solving the problem of foam failing to pass environmental protection tests; it can address the issue of foam fragility and cracking when encountering heavy-duty products; it can eliminate the risk of foam being flammable and causing fires; it can overcome the geographical limitations of foam's large volume and light texture, which are inconvenient for long-distance transportation; and it can solve the problem of single-wall plastic corner protectors lacking cushioning functions.

10 Claims, 5 Drawing Sheets

DOUBLE-LAYER STRUCTURED CUSHIONING CORNER PROTECTOR

1. TECHNICAL FIELD

The invention relates to the technical field of product packaging, in particular to a double-layer structured cushioning corner protector.

2. BACKGROUND ART

Currently, most household appliances, furniture, cabinets, and other products suitable for protection with foam or plastic corner protectors on the market adopt foam or plastic corner protectors to prevent damage during transportation. However, both foam and plastic corner protectors have significant drawbacks when used.

Foam corner protectors have the following drawbacks:

1. they lack environmental friendliness; foam products are not eco-friendly, as foam is difficult to degrade, contains many toxic substances, and fails to pass environmental tests; additionally, foam easily breaks into tiny, non-recyclable particles, forming microplastics that pose serious risks to animals and the natural environment;
2. although foam has good cushioning properties, its strength is limited, and it is very brittle; when protecting heavier products, it is prone to cracking and losing its protective function; therefore, foam protection has certain limitations for heavier products;
3. foam is an extremely flammable material; it ignites immediately upon contact with a spark and is difficult to extinguish; regardless of where it is stored, there is a fire hazard;
4. foam has a large volume and low weight, with low strength, requiring significant storage space and making it unsuitable for long-distance transportation.

Ordinary plastic corner protectors have the following drawbacks:

1. they lack cushioning ability as they are single-walled corner protectors;
2. heavy-weight plastic corner protectors are expensive, significantly increasing packaging costs;
3. ordinary plastic corner protectors are relatively hard; when used to protect delicate products or products with non-rigid surface materials, they can easily cause scratches.

3. SUMMARY OF THE INVENTION

To solve the above problems, the invention provides the following technical scheme: a double-layer structured cushioning corner protector comprises a corner protector body; the corner protector body has a double-layer wall structure, a cavity is arranged between the double-layer walls, a cushioning protection groove is arranged on an inner side of the corner protector body, inner concave holes are arranged on inner walls of the cushioning protection groove, outer concave holes are arranged on outer walls of the corner protector body, the inner concave holes and the outer concave holes are arranged opposite to each other.

As an optimal technical scheme of the invention, the positions of the inner concave holes and the outer concave holes correspond to each other.

As an optimal technical scheme of the invention, an inner top corner is arranged inside the cushioning protection groove, an outer top corner is arranged outside the corner protector body, the inner concave holes are close to the inner top corner, and the outer concave holes are close to the outer top corner.

As an optimal technical scheme of the invention, one corner of the inner concave hole protrudes toward an interior of the cavity to form a cushioning corner, the cushioning corner is located on one side of the inner top corner, and the protruding distance of the cushioning corner into the cavity is greater than that of the inner top corner.

As an optimal technical scheme of the invention, one side wall of the outer concave hole extends near the outer top corner to form a cushioning claw, the cushioning claw is located near the outer top corner, and the distance that the cushioning claw extends toward the outer top corner is greater than that of the inner top corner.

As an optimal technical scheme of the invention, both the inner concave holes and the outer concave holes are one of blind holes, counterbores, or through holes.

As an optimal technical scheme of the invention, first reinforcing ribs are arranged on the inner walls of the cushioning protection groove, first cushioning grooves are arranged on both sides of each first reinforcing rib on the inner walls of the cushioning protection groove, the first reinforcing ribs on adjacent inner walls of the cushioning protection groove are connected into one piece.

As an optimal technical scheme of the invention, second reinforcing ribs are arranged on the outer walls of the corner protector body, second cushioning grooves are arranged on both sides of each second reinforcing rib on the outer walls of the corner protector body, the second reinforcing ribs on adjacent outer walls of the corner protector body are connected into one piece.

As an optimal technical scheme of the invention, the inner walls of the cushioning protection groove are coated, encapsulated, or polymerized with a layer of soft material, and the corner protector body is made of a tough material.

As an optimal technical scheme of the invention, the cushioning protection groove is one of a triangular shape, an L-shape, or a rectangular shape, both the inner concave holes and the outer concave holes are one of square, circular, elliptical, or polygonal shapes.

Compared with the prior art, the invention has the following advantages:

the double-layer structured cushioning corner protector uses environmentally friendly flame-retardant and tough materials to manufacture the protective corner body with a double-wall cushioning structure, which can achieve the cushioning performance required for packaging while solving the problem of foam failing to pass environmental protection tests; it can address the issue of foam fragility and cracking when encountering heavy-duty products; it can eliminate the risk of foam being flammable and causing fires; it can overcome the geographical limitations of foam's large volume and light texture, which are inconvenient for long-distance transportation; and it can solve the problem of single-wall plastic corner protectors lacking cushioning functions. The concave holes and reinforcing ribs on the inner and outer walls of this cushioning corner protector significantly increase the strength of the corner protector body, thereby reducing wall thickness, decreasing product weight, greatly saving materials, and reducing packaging costs; the use of soft material addresses the current issue of surface hardness in plastic corner protectors.

4. BRIEF DESCRIPTION OF ACCOMPANY DRAWINGS

Figure 1:
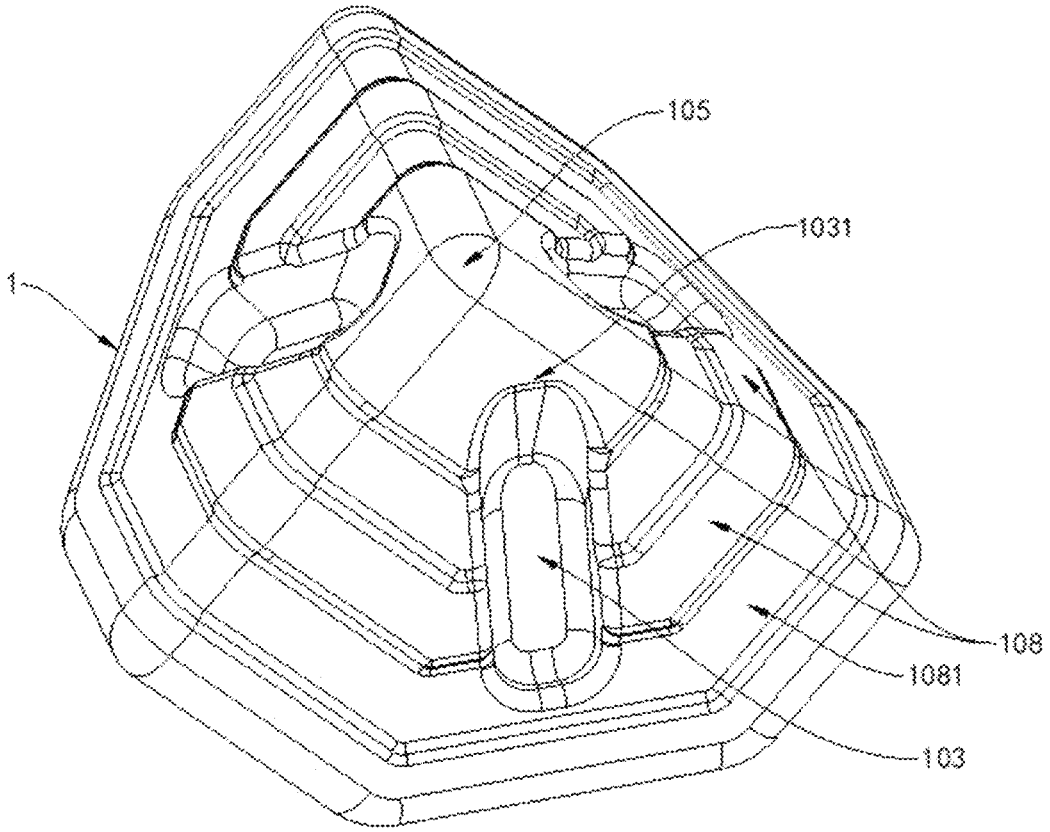
FIG. 1 is a schematic diagram of the structure of the outer concave holes of the double-layer structured cushioning corner protector of the invention.
Figure 2:
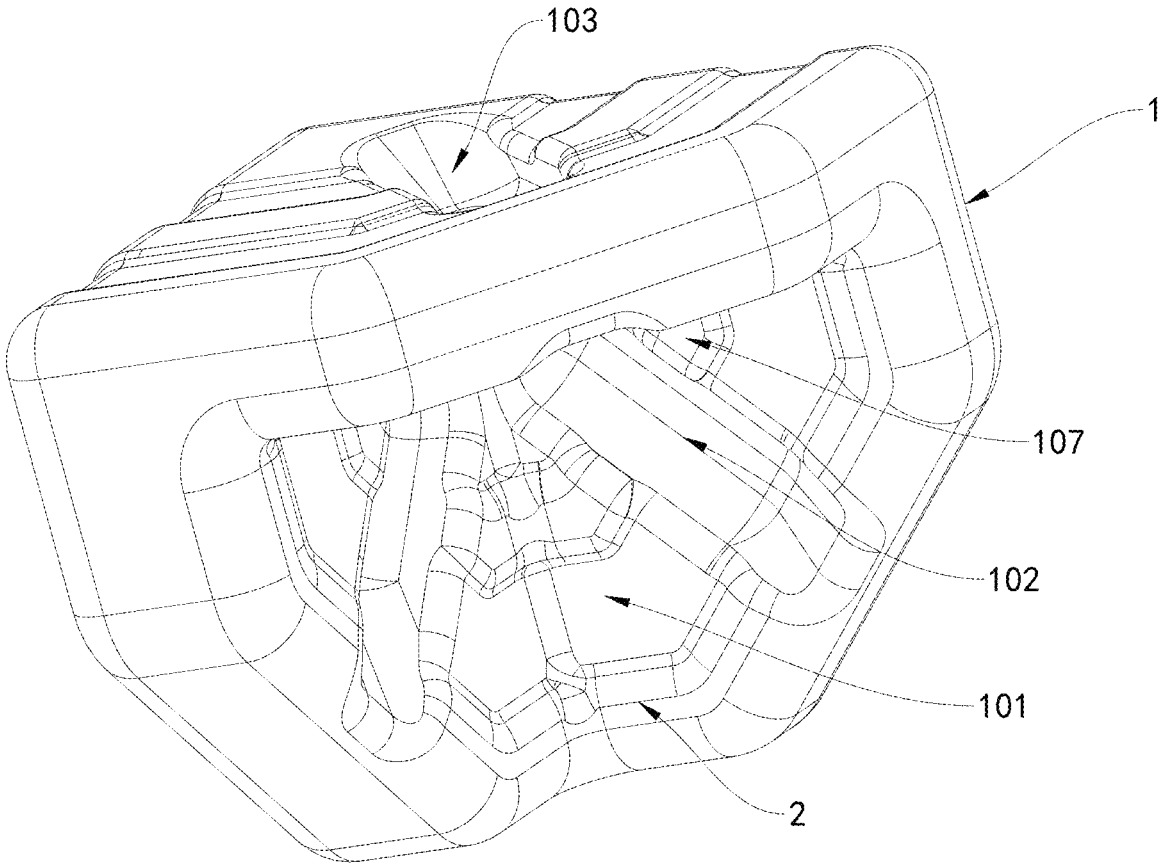
FIG. 2 is a schematic diagram of the structure of the inner concave holes of the double-layer structured cushioning corner protector of the invention.
Figure 3:
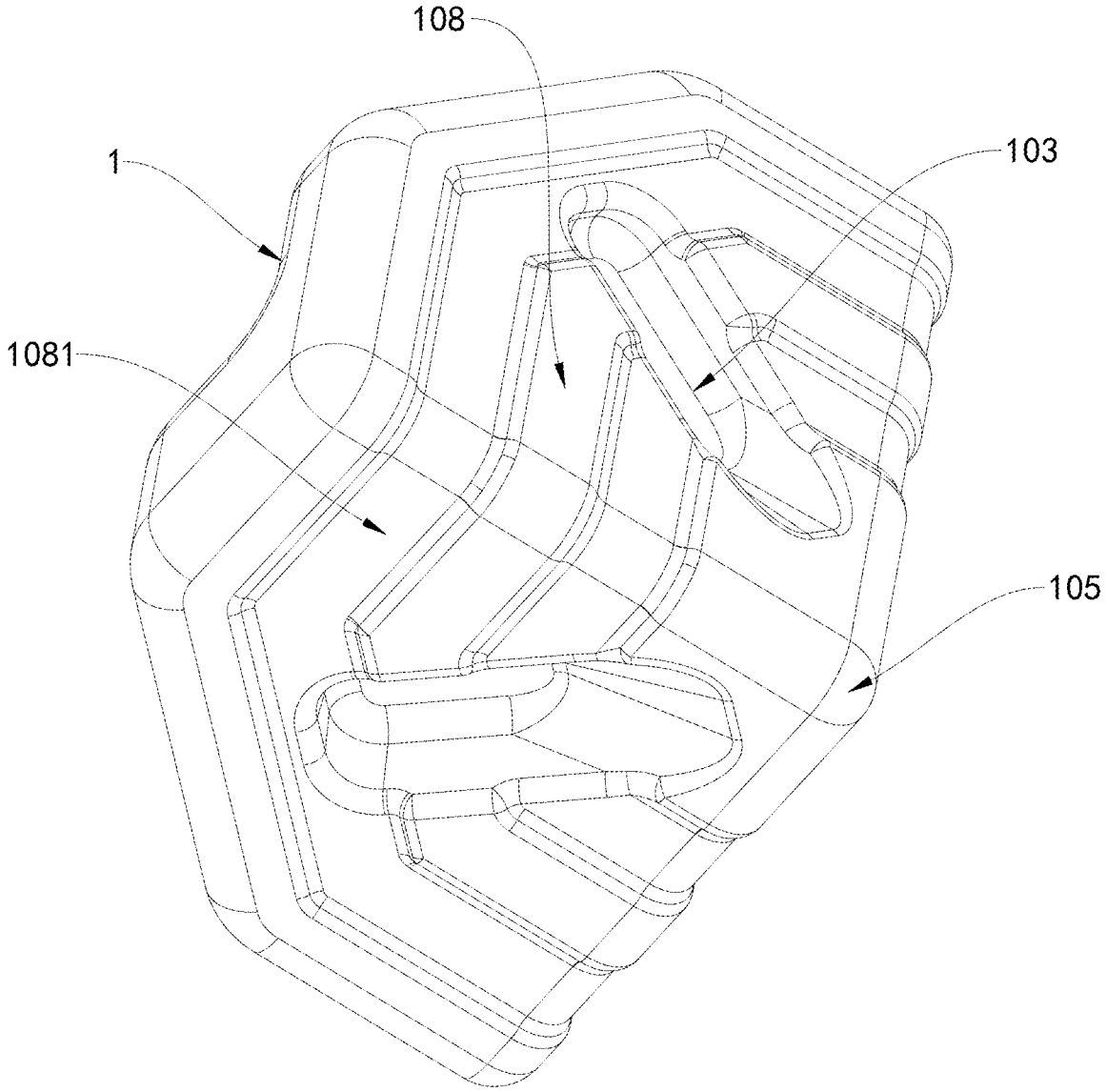
FIG. 3 is a schematic diagram of the structure of the second reinforcing ribs of the double-layer structured cushioning corner protector of the invention.
Figure 4:
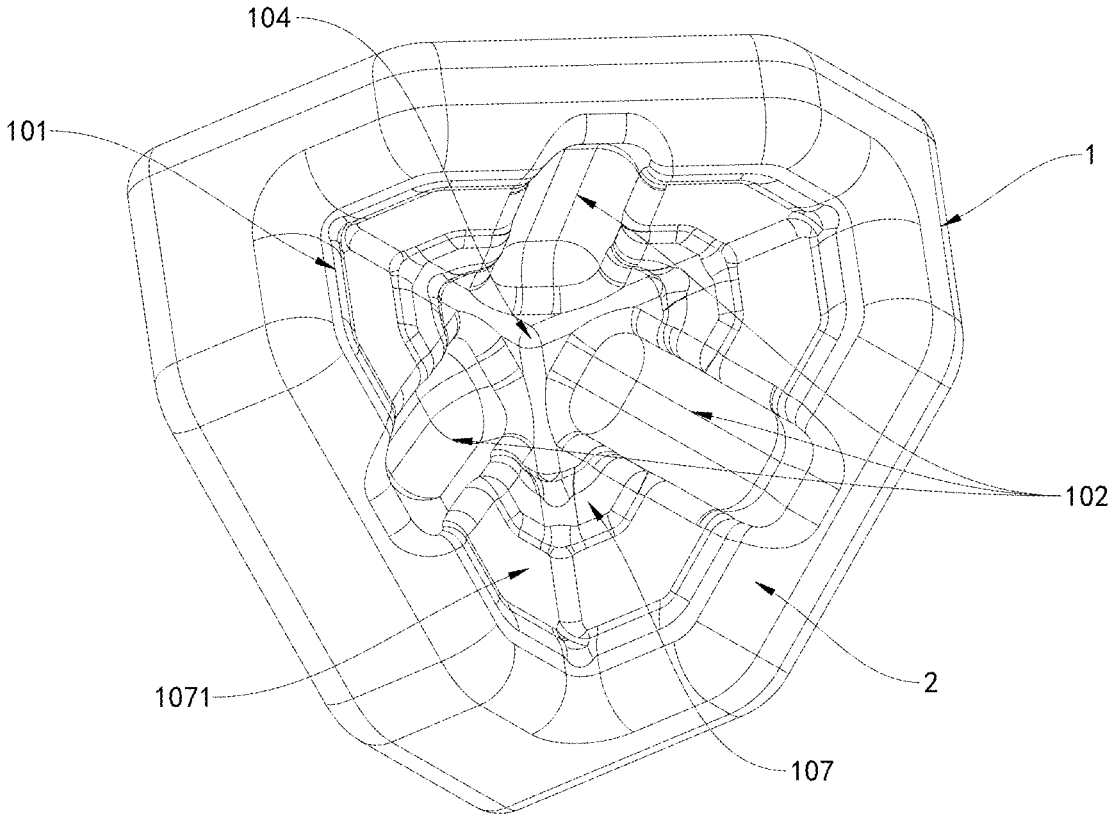
FIG. 4 is a schematic diagram of the structure of the cushioning protection groove of the double-layer structured cushioning corner protector of the invention.

In the figures: 1 corner protector body; 101 cushioning protection groove; 102 inner concave hole; 103 outer concave hole; 1031 cushioning claw; 104 inner top corner; 105 outer top corner; 106 cushioning corner; 107 first reinforcing rib; 1071 first cushioning groove; 108 second reinforcing rib; 1081 second cushioning groove; 109 cavity; 2 soft material; 3 protected product; F external impact force.

5. SPECIFIC EMBODIMENT OF THE INVENTION

In order to enable a more detailed understanding of the features and technical contents of the embodiments of the invention, the implementation of the embodiments of the invention is described in detail below in combination with the accompanying drawings. The accompanying drawings are for reference only and are not used to limit the embodiments of the invention. In the following technical description, for the sake of convenience of explanation, multiple details are provided to provide a full understanding of the embodiments. However, one or more embodiments may still be implemented without these details. In other cases, well-known structures and devices may be simplified to simplify the drawings.

The terms "first", "second", etc. in the specification and claims of the embodiments of the invention and the above-mentioned drawings are used to distinguish similar objects, and are not necessarily used to describe a specific order or sequence. It should be understood that the numbers used in this way can be interchanged where appropriate to describe the embodiments of the invention. In addition, the terms "comprise", and "be provided with" and any variations thereof, are intended to cover a non-exclusive inclusion.

In the embodiments of the invention, it should be understood that the orientation or positional relationship indicated by the terms "upper", "lower", "inner", "center", "outer", "front", "rear" and so on are based on the orientation or positional relationship shown in the accompanying drawings, only for the convenience of describing the invention, rather than indicating or implying that the indicated device or element must have a specific orientation, as well as a specific orientation structure and operation. In addition, some of the above terms may be used to express other meanings in addition to indicating a direction or position relationship. For example, the term "on" may also be used to express a certain dependency or connection relationship in some cases. For those skilled in the art, the specific meanings of these terms in the embodiments of the invention can be understood according to the specific circumstances.

Furthermore, the terms of "arrange", "connect", "fix", etc., should be understood broadly. For example, the "connect" may refer to fixed connection, detachable connection or integral connection; the "connect" may also refer to mechanical connection or electrical connection; the means of "connect" may be directly connected or indirectly connected through an intermediate medium, and may be internal communication between two devices, components or parts. For those skilled in the art, the specific meaning of the above terms in the invention can be understood according to the specific situation.

Unless otherwise specified, the term "a plurality of" means two or more.

It should be noted that, in the absence of conflict, the technical features of the above embodiments of the invention can be combined with each other.

Please refer to FIG. 1-5, a double-layer structured cushioning corner protector comprises a corner protector body 1, the corner protector body 1 has a double-layer wall structure, a cavity 109 is arranged between the double-layer walls, a cushioning protection groove 101 is arranged on an inner side of the corner protector body 1, inner concave holes 102 are arranged on inner walls of the cushioning protection groove 101, outer concave holes 103 are arranged on outer walls of the corner protector body 1, the inner concave holes 102 and the outer concave holes 103 are arranged opposite to each other. Using environmentally friendly flame-retardant and tough materials to manufacture the protective corner body 1 with a double-wall cushioning structure can achieve the cushioning performance required for packaging while solving the problem of foam failing to pass environmental protection tests; it can address the issue of foam fragility and cracking when encountering heavy-duty products; it can eliminate the risk of foam being flammable and causing fires; it can overcome the geographical limitations of foam's large volume and light texture, which are inconvenient for long-distance transportation; and it can solve the problem of single-wall plastic corner protectors lacking cushioning functions. The inner concave holes 102 and outer concave holes 103, along with first reinforcing ribs 107 and second reinforcing ribs 108, on the inner and outer walls of this cushioning corner protector significantly increase the strength of the corner protector body 1, thereby reducing wall thickness, decreasing product weight, greatly saving materials, and reducing packaging costs; the use of soft material 2 addresses the current issue of surface hardness in plastic corner protectors.

Figure 5:
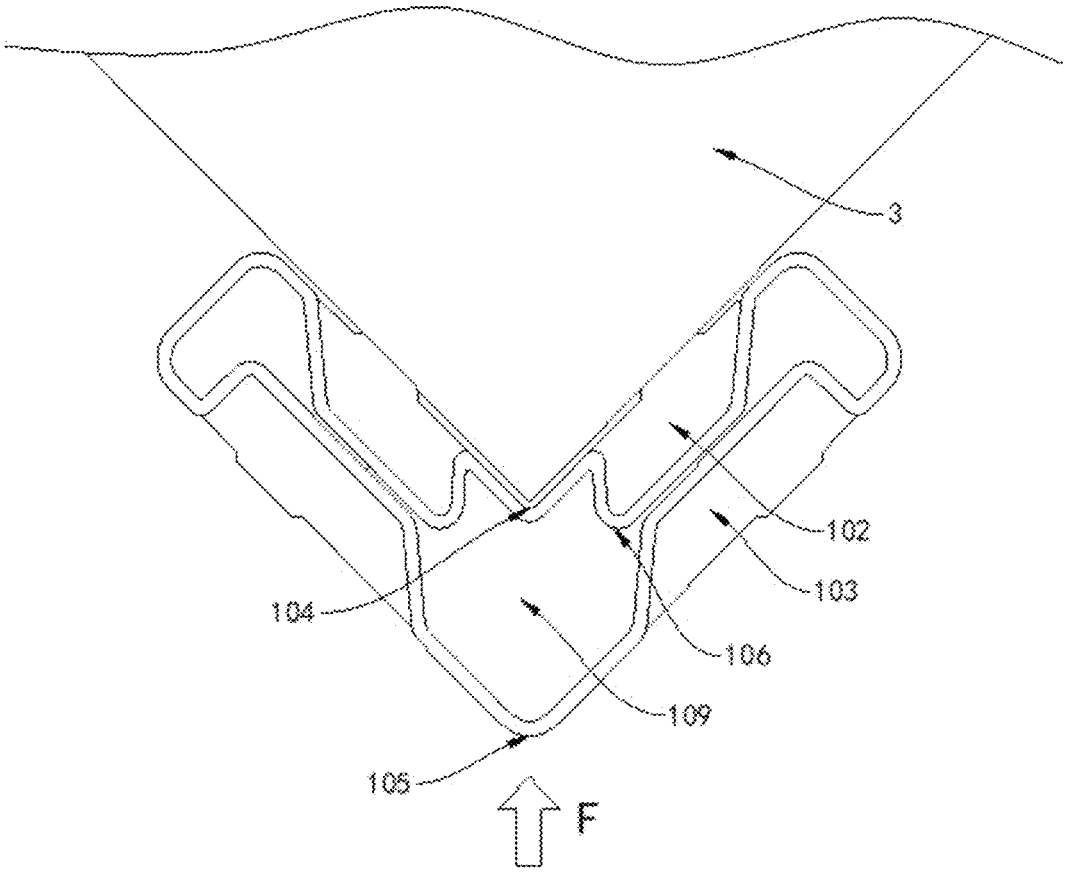
FIG. 5 is a schematic diagram of the the structure of the cavity of the double-layer structured cushioning corner protector of the invention.

As a specific technical scheme of this embodiment, the positions of the inner concave holes 102 and the outer concave holes 103 correspond to each other, their bottom distances can be adjusted as needed, with a minimum reduction to 0 mm, the inner concave holes 102 and the outer concave holes 103 provide support for the inner and outer walls; referring to FIG. 5, the distance between bottom surfaces of the inner concave holes 102 and the outer concave holes 103 is very small or they are in contact or integrated into one piece; when the bottom surfaces of the inner concave holes 102 and the outer concave holes 103 are in contact with each other, they can provide localized support for the inner and outer walls, increasing the strength of the corner protector body 1; with the same protective effect, the structural design of the inner concave holes 102 and the outer concave holes 103 can reduce wall thickness, which can save material, and lower manufacturing costs; increasing the wall thickness of the double-layer corner protector can enhance the strength of the corner protector body 1 to cope with products of various weights available on the market.

As a specific technical scheme of this embodiment, an inner top corner 104 is arranged inside the cushioning protection groove 101, an outer top corner 105 is arranged outside the corner protector body 1, the inner concave holes 102 are close to the inner top corner 104, and the outer concave holes 103 are close to the outer top corner 105, one corner of the inner concave hole 102 protrudes toward an interior of the cavity 109 to form a cushioning corner 106, the cushioning corner 106 is located on one side of the inner top corner 104, and the protruding distance of the cushioning corner 106 into the cavity 109 is greater than that of the inner top corner 104, which can provide effective protection for a protected product 3; referring to FIG. 5, in this embodiment, the corner protector body 1 and the cushioning protection groove 101 are both triangular; the outer concave holes 103 on the three outer walls of the corner protector body 1 are located close to the outer top corner 105; in this way, when the outer top corner 105 of the corner protector body 1 touches the ground, the force direction (refer to the F arrow direction in FIG. 5) first undergoes a period of cushion, then reaches the cushioning claws 1031 formed by the hole walls of the three outer concave holes 103; the structure of the outer concave holes 103 provides reinforcement, and the wall thickness direction of the cushioning claws 1031 is facing toward the direction of the external impact force F, which transforms the original force on the wall surface into force along the wall thickness direction, significantly enhancing the strength of the force bearing capability. The inner concave holes 102 on the inner walls of the cushioning protection groove 101 are located close to the inner top corner 104, protruding parts of the three inner concave holes 102 on the three inner walls of the cushioning protection groove 101 towards the interior of the cavity 109 form the cushioning corners 106; when the outer top corner 105 of the corner protector body 1 is deformed by the external impact force F and exceeds the rebound force of the outer wall and the resistance force of the outer concave holes 103, the cushioning corners 106 can still withstand the external impact force, further protecting the product from external forces.

As a specific technical scheme of this embodiment, both the inner concave holes 102 and the outer concave holes 103 are one of blind holes, counterbores, or through holes; when the inner concave holes 102 and the outer concave holes 103 fit together or are connected into one, forming blind holes or through holes, the inner concave holes 102 and the outer concave holes 103 can provide support and reinforcement for both the inner and outer walls; when the inner concave holes 102 and the outer concave holes 103 are counterbores, the distance between the bottom surfaces of the inner concave holes 102 and the outer concave holes 103 can be adjusted as needed to increase cushioning performance or increase support strength, thereby achieving a balanced effect of cushioning and strength; according to the need of adjusting cushioning performance and overall strength, the inner concave holes 102 and the outer concave holes 103 can also be staggered from each other, the hole walls of the concave holes 102 and the outer concave holes 103 can still provide good support to the inner and outer walls on both sides of the cavity 109, further increasing the flexibility in selecting the optimal match between cushioning performance and overall strength.

As a specific technical scheme of this embodiment, first reinforcing ribs 107 are arranged on the inner walls of the cushioning protection groove 101, first cushioning grooves 1071 are arranged on both sides of each first reinforcing rib 107 on the inner walls of the cushioning protection groove 101, the first reinforcing ribs 107 on adjacent inner walls of the cushioning protection groove 101 are connected into one piece; second reinforcing ribs 108 are arranged on the outer walls of the corner protector body 1, second cushioning grooves 1081 are arranged on both sides of each second reinforcing rib 108 on the outer walls of the corner protector body 1, the second reinforcing ribs 108 on adjacent outer walls of the corner protector body 1 are connected into one piece; the cooperation of first reinforcing ribs 107, second reinforcing ribs 108, first cushioning grooves 1071, and second cushioning grooves 1081 can provide a good plane reinforcement effect for the inner wall of the cushioning protection groove 101 and the outer wall of the corner protector body 1; in this way, the same level of protection can be achieved with a much thinner wall thickness, which not only softens the product, but also saves material and reduces manufacturing costs.

As a specific technical scheme of this embodiment, the inner walls of the cushioning protection groove 101 are coated, encapsulated, or polymerized with a layer of soft material 2; the soft material 2 can be soft rubber, EVA, rubber, or other materials with equivalent properties; this ensures that the cushioning protection groove 101 will not scratch the contact surface between the protected product 3 and the cushioning protection groove 101.

As a specific technical scheme of this embodiment, the corner protector body 1 is made of a tough material; the tough material can be environmentally friendly plastic or a highly elastic metal sheet; when the outer wall made from this tough material is subjected to external impact, it deforms inward, and the reactive force counteracts the impact force, achieving a cushioning effect.

As a specific technical scheme of this embodiment, the cushioning protection groove 101 is one of a triangular shape, an L-shape, or a rectangular shape, both the inner concave holes 102 and the outer concave holes 103 are one of square, circular, elliptical, or polygonal shapes; when the cushioning protection groove 101 is triangular, it can protect products with triangular edges; when the cushioning protection groove 101 is L-shaped, it can protect products with L-shaped edges; when the cushioning protection groove 101 is rectangular, it can be used as a cover to protect the four sides of the product.

In conclusion, the double-layer structured cushioning corner protector uses environmentally friendly flame-retardant and tough materials to manufacture the protective corner body 1 with a double-wall cushioning structure, which can achieve the cushioning performance required for packaging while solving the problem of foam failing to pass environmental protection tests; it can address the issue of foam fragility and cracking when encountering heavy-duty products; it can eliminate the risk of foam being flammable and causing fires; it can overcome the geographical limitations of foam's large volume and light texture, which are inconvenient for long-distance transportation; and it can solve the problem of single-wall plastic corner protectors lacking cushioning functions. The concave holes and reinforcing ribs on the inner and outer walls of this cushioning corner protector significantly increase the strength of the corner protector body 1, thereby reducing wall thickness, decreasing product weight, greatly saving materials, and reducing packaging costs; the use of soft material 2 addresses the current issue of surface hardness in plastic corner protectors.

The above description and the accompanying drawings sufficiently illustrate the embodiments of the invention to enable those skilled in the art to practice them. Other embodiments may include structural and other changes. The embodiments represent only possible variations. Unless explicitly required, individual components and functions are optional, and the order of operations may vary. Some parts and features of some embodiments may be included in or replace parts and features of other embodiments. The embodiments of the invention are not limited to the structures described above and illustrated in the accompanying drawings. Various modifications and changes can be made without departing from their scope. The scope of the invention is limited only by the appended claims.

The invention claimed is:

1. A double-layer structured cushioning corner protector, comprising a corner protector body, wherein the corner protector body has a double-layer wall structure, a cavity is arranged between the double-layer walls, a cushioning protection groove is arranged on an inner side of the corner protector body; furthermore, to increase strength, inner concave holes are arranged on inner walls of the cushioning protection groove, outer concave holes are arranged on outer walls of the corner protector body, the inner concave holes and the outer concave holes are arranged opposite to each other.

2. The double-layer structured cushioning corner protector of claim 1, wherein the positions of the inner concave holes and the outer concave holes correspond to each other.

3. The double-layer structured cushioning corner protector of claim 1, wherein an inner top corner is arranged inside the cushioning protection groove, an outer top corner is arranged outside the corner protector body, the inner concave holes are close to the inner top corner, and the outer concave holes are close to the outer top corner.

4. The double-layer structured cushioning corner protector of claim 3, wherein one corner of the inner concave hole protrudes toward an interior of the cavity to form a cushioning corner, the cushioning corner is located on one side of the inner top corner, and protruding distance of the cushioning corner into the cavity is greater than that of the inner top corner.

5. The double-layer structured cushioning corner protector of claim 3, wherein one side wall of each outer concave hole extends near the outer top corner to form a cushioning claw, the cushioning claw is located near the outer top corner, and the distance that the cushioning claw extends toward the outer top corner is greater than that of the inner top corner.

6. The double-layer structured cushioning corner protector of claim 1, wherein both the inner concave holes and the outer concave holes are one of blind holes, counterbores, and through holes.

7. The double-layer structured cushioning corner protector of claim 1, wherein first reinforcing ribs are arranged on inner walls of the cushioning protection groove, first cushioning grooves are arranged on both sides of each first reinforcing rib on the inner walls of the cushioning protection groove, the first reinforcing ribs on adjacent inner walls of the cushioning protection groove are connected into one piece.

8. The double-layer structured cushioning corner protector of claim 1, wherein second reinforcing ribs are arranged on outer walls of the corner protector body, second cushioning grooves are arranged on both sides of each second reinforcing rib on the outer walls of the corner protector body, the second reinforcing ribs on adjacent outer walls of the corner protector body are connected into one piece.

9. The double-layer structured cushioning corner protector of claim 1, wherein the inner walls of the cushioning protection groove are one of coated, encapsulated, and polymerized with a layer of soft material, and the corner protector body is made of a tough material.

10. The double-layer structured cushioning corner protector of claim 1, wherein the cushioning protection groove is one of a triangular shape, an L-shape, and a rectangular shape, both the inner concave holes and the outer concave holes are one of square, circular, elliptical, and polygonal shapes.

* * * * *